United States Patent [19]

Burke et al.

[11] Patent Number: 4,524,550

[45] Date of Patent: Jun. 25, 1985

[54] DISCHARGE OF BLASTING MEDIA FROM A TREATING CHAMBER

[75] Inventors: Thomas W. Burke, Allentown; David J. Klee, Emmaus, both of Pa.

[73] Assignee: Air Products and Chemicals, Inc., Allentown, Pa.

[21] Appl. No.: 445,603

[22] Filed: Nov. 30, 1982

[51] Int. Cl.[3] ..... B24C 9/00

[52] U.S. Cl. ..... 51/424; 51/426; 277/DIG. 5; 222/410

[58] Field of Search ..... 51/425, 436, 426, 424, 51/292, 263; 222/241, 236, 410; 384/134; 277/DIG. 1, DIG. 5

[56] References Cited

U.S. PATENT DOCUMENTS

| | | | |
|---|---|---|---|
| 1,940,138 | 12/1933 | McAdam | 222/242 |
| 2,170,831 | 8/1939 | Minich | 51/9 |
| 2,365,948 | 12/1944 | Gossard | 51/424 |
| 2,516,918 | 8/1950 | Roubal | 384/134 |
| 2,590,576 | 3/1952 | Rosenberger et al. | 51/9 |
| 3,703,789 | 11/1972 | Zeidler | 51/426 |
| 3,742,650 | 7/1973 | Graf et al. | 51/425 |
| 3,798,841 | 3/1974 | Eppler | 51/436 |
| 3,824,739 | 7/1974 | Moret et al. | 51/9 |
| 3,942,771 | 3/1976 | Knutsen | 222/410 |
| 4,336,672 | 6/1982 | Kwolek | 51/432 |
| 4,423,830 | 1/1984 | Lents et al. | 222/242 |

FOREIGN PATENT DOCUMENTS

| | | | |
|---|---|---|---|
| 1112048 | 11/1981 | Canada | 51/1 |
| 1063974 | 8/1959 | Fed. Rep. of Germany | 222/236 |
| 282039 | 4/1952 | Switzerland | 222/236 |

*Primary Examiner*—Frederick R. Schmidt
*Assistant Examiner*—Robert Rose
*Attorney, Agent, or Firm*—James C. Simmons; E. Eugene Innis

[57] ABSTRACT

In the blasting of articles with impact media, the mixture of used media and fragments of material thereby removed from said articles fall to the bottom of the thermally insulated treating chamber. Novel structure is herein disclosed for discharging such mixture through an opening in the bottom of the chamber, utilizing a rotating sweeping device having a plurality of sweep arms extending outwardly from a central hub each of the arms being formed of segments to approximate the shape of an ogee curve. Heat leakage into the chamber is minimized by driving the sweeping device from below the bottom of the chamber by an enclosed shaft passed through the insulated bottom of the chamber.

4 Claims, 4 Drawing Figures

DISCHARGE OF BLASTING MEDIA FROM A TREATING CHAMBER

The present application is related to application Ser. No. 445,778 filed of even date herewith.

TECHNICAL FIELD

The present invention relates to systems for shot-blasting of molded or coated articles, respectively for removal of flash and coatings therefrom. It is particularly concerned with systems wherein the treatment is carried out in an insulated enclosure containing chilling gas, to facilitate such removal by embrittlement.

BACKGROUND OF THE INVENTION

It is a known technique to remove flash from molded plastic and elastomeric articles and paint or coatings from various articles by contacting these with a chilling medium, generally at cryogenic temperature, to embrittle the flash or coating, and subjecting such articles to impact by a high velocity stream of solid particles in the form of shot or pellets.

In a typical operation the piece or pieces to be treated are introduced into a heat-insulated chamber maintained at required low temperature and the stream of blasting media is impelled at high velocity against the surface of each piece by a rotating impeller or so-called throwing wheel. The discharged blasting media together with the fragments of the flash or coating thereby removed, are collected and conveyed out of the treating chamber to a screening apparatus in which the blasting media is separated and recovered for recycling to the blasting operation, and the larger fragments of flash and coating materials as well as fines are discharged. A system of this general type is described in U.S. Pat. No. 3,824,739.

In certain of these systems, as shown for example in Canadian Pat. No. 1,112,048, the used media after impacting the article being treated, together with the refuse comprising material removal from the article by the impact, falls to the bottom of the treating chamber. The material from the bottom of the chamber is conveyed by a screw conveyor to a reservoir. From the reservoir, the collected media and refuse are removed by a flexible helical conveyor and transported to a separation apparatus provided with screens of graduated size, whereby the clean blasting media freed of refuse is recovered for recirculation to the throwing wheel.

In systems employed for the removal of organic coatings from articles by shot blasting the chilled articles, these coatings fall off in discrete pieces that vary in size from larger flakes to fine dust which become mixed with the used shot. In order to reuse the shot, the mixture falling to the bottom of the treating chamber needs to be collected and transported to the separation system. Since the coating removal process will operate from room temperature to about −200° F. (−129° C.), the media collection system must be capable of withstanding the thermal contraction and expansion encountered in this temperature range. In addition, moisture will accumulate in the system due to condensation, requiring the mechanism to be resistant to water freezing and accumulation of ice. The treating chamber is relatively large and comprises a correspondingly large floor that needs to be freed of the mixture of refuse and shot falling thereon. Moreover, since the system is generally cooled by a liquefied gas, such as liquefied nitrogen, the treating chamber must be thermally insulated to minimize consumption of the coolant. Accordingly, for economic operation, the system, including the arrangement for collection and discharge of the mixture of refuse and shot at the bottom of the treating chamber, must be designed to minimize heat leak into the chamber and must be free of openings which would permit escape of the liquefied gas, or the entry of water vapor into the chamber.

A recently advocated system employed in an attempt to overcome the foregoing problems associated with a cryogenic system for shot blasting of coated articles, made use of the combination of a drag conveyor and a cross screw conveyor. The drag conveyor comprised a series of flat bars moved along the bottom of an insulated chamber by endless chains attached to sprockets mounted on a minimum of two rotating shafts penetrating the insulated chamber. These bars push the mixture of blasting media and removed coatings toward the cross screw conveyor, which latter is a helical auger turning in a trough. The helical auger is also mounted on a shaft which penetrates the chamber. As the helical auger rotates, it moves the mixture toward an opening at one end of the trough for transfer to the separation system.

The described system of a drag conveyor and cross screw conveyor has a number of disadvantages. The drag conveyor uses a roller chain that is subject to failure from the repeated freezing of moisture trapped between the side bars of the chain. Since the operating temperature of the chamber is lower than the rated temperature for known lubricants, the bearings for the shafts on which the sprockets are mounted, must be located outside of the chamber. Thus, the shafts and their openings into the chamber wall result in a large heat leak into the system. Also, since the drag conveyor bearings are mounted outside the chamber, an adjusting device must be provided to compensate for the thermal contraction of the roller chain. The drag conveyor and cross screw auger are complex devices that make it difficult to clean the bottom surface of the chamber. Further, large pieces of removed coating material or ice can easily jam these mechanisms. Tacky materials, such as uncured coatings, will cause severe problems from jamming due to the progressive build-up of layers on the operating components. Also, the uncured material may polymerize or solidify in inaccessible cracks and crevices.

Among the objects of the present invention is to provide an improved arrangement for the collection and discharge of the mixture of blasting media and refuse at the bottom of an insulated shot-blasting enclosure, avoiding the deficiencies encountered in operation of prior art systems.

SUMMARY OF THE INVENTION

In accordance with the present invention a rotating sweeping device is mounted above the bottom of an enclosure, adjacent to an opening in the bottom. The device comprises a plurality of outwardly extending sweep arms traversing the bottom of the enclosure for sweeping into the opening any solid materials that are introduced into the enclosure and that fall to the bottom; each of the sweep arms being attached to a central hub and shaped to approximate an ogee curve, with the innermost portion of the arm being displaced or bent rearwardly away from the direction of rotation and the outermost portion being displayed forwardly in the direction of rotation.

In accordance with one embodiment of the present invention a vaned sweeping device is employed in a cryogenic deflashing or decoating system for removing blasting media and solid refuse from the bottom of an insulated chamber. In this system the sweeping device is mounted for horizontal rotation at the bottom of the blasting chamber. During rotation of the sweeping device, the vanes push the material that has fallen to the floor of the chamber, towards an opening in the bottom of the chamber. In a preferred arrangement, the sweeping device is provided with a plurality of vanes or arms equally spaced from one another and extending outwardly from the hub of the device. Each of these arms approximates the shape of an ogee curve in which the inner position of the curve (nearest the axis of rotation) is displaced outwardly and rearwardly away from the direction of rotation while the outer portion of the curve is displaced forwardly toward the direction of rotation. Thus, the mixture of refuse and shot on the floor of the treating chamber is moved both radially outward and radially inward toward the discharge opening at the floor of the chamber to the inlet of a moving conveyor transporting the material to a separation system.

For most efficient operation, the reversal in curvature of the sweep arm should be at the point such that area of the circular path traversed by the outwardly moving material is substantially equal to the area of the annular path traversed by the inwardly moving material at the outer portion of the arm. The rotational speed of the sweeping device is mathematically established by taking into consideration the flow rate and bulk density of the blasting media, the number of arms on the sweeping device, the area of the chamber floor traversed by the device and the depth of the material on the floor of the chamber.

While the arms of the sweeping device are hereinabove described as being curved in the form approximating an ogee curve, such arms may be made up, for economy of construction, of a plurality of adjoined straight segments, as will hereinafter appear.

In contrast to the currently available commercial cryogenic systems for collecting media and refuse from the bottom of an insulated chamber, the present system minimizes heat leaks into the enclosure. Because there is only a single support for the operating shaft, the apparatus of the present invention eliminates thermal contraction problems associated with the current systems.

The operation of the discharge system according to the invention will be more fully understood and its several advantages appreciated from the detailed description below, read in connection with the accompanying drawings illustrating a preferred embodiment.

DETAILED DESCRIPTION

Figure 1:
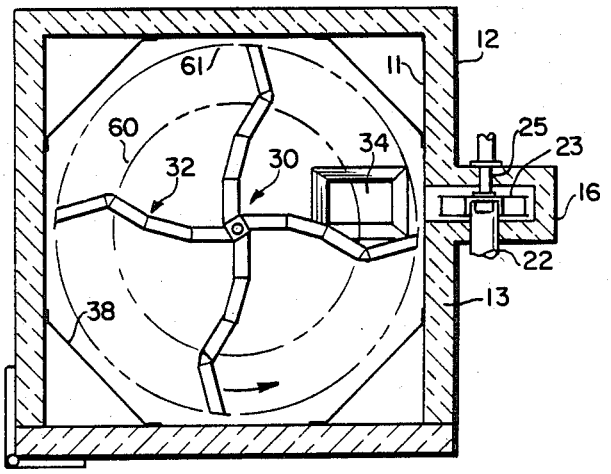
FIG. 1 is a top plan view of a shot blasting chamber, taken along the line 1—1 of FIG. 2, a portion being broken away and shown in section.
Figure 2:
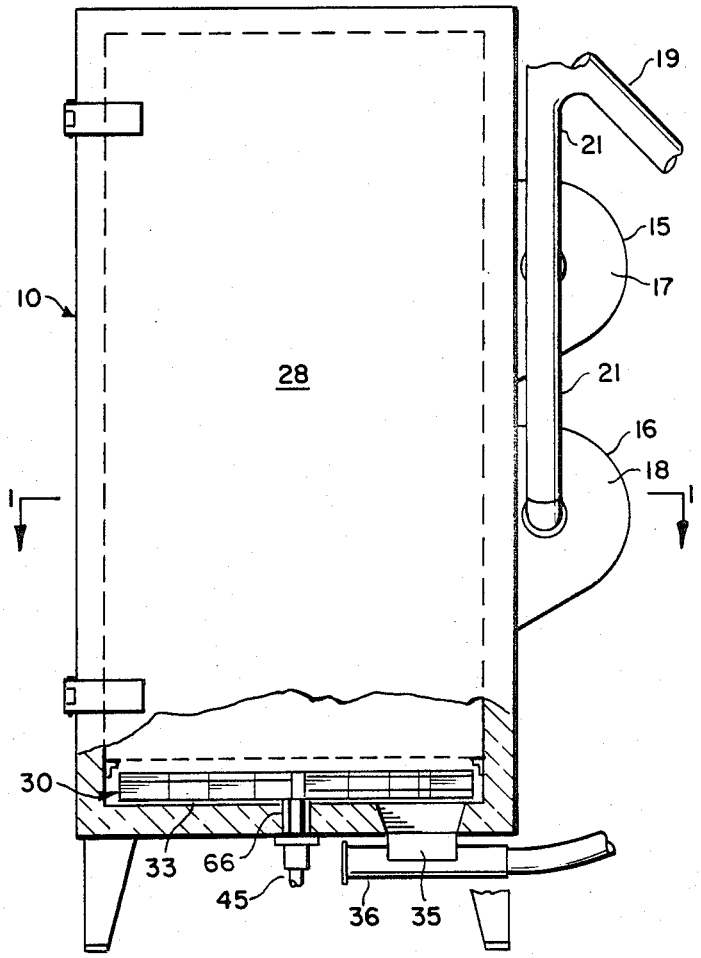
FIG. 2 is a front elevation of the blasting chamber, partly in section.

Referring to FIGS. 1 and 2 of the drawings, the treating chamber 10 is shown as substantially square in cross-section and is formed of inner and outer walls 11 and 12 provided with suitable thermal insulation 13 therebetween. The top and bottom of the chamber are similarly insulated.

Mounted on a side chamber are vaned throwing wheels 15 and 16 enclosed in insulating housings 17 and 18 respectively. Blasting media, in the form of shot or pellets is supplied to the throwing wheels in known manner from a reservoir (not shown) containing separated clean media and fresh make up material, by a flexible screw conveyor enclosed in tubular housing 19. At the upper terminal of the screw conveyor, the conveyed media is dropped into a pair of parallel downcomers 21, each discharging into separate horizontal conduits 22 through which the media is conducted into the center of the throwing wheel in the spaces between the rotating vanes or blades 23 of each of the wheels. Each of the wheels is mounted on a hub attached to a shaft 25 driven by suitable means not shown. Arrangements of the general type above described for supplying blasting media to a throwing wheel are shown and described in U.S. Pat. Nos. 2,170,831; 2,590,576; 3,703,789; 4,336,672; Canadian Pat. No. 1,112,048 and in copending application Ser. No. 445,778 filed of even date herewith, the description of which is incorporated herein by reference.

As will be understood, the throwing wheels are rotated at high velocity to hurl the impact media against articles positioned within the insulated chamber 10, thereby effecting the desired removal of coatings thereon or of flash from molded articles. The present invention is of greatest importance in systems for coating removal, in which the handling problems for collection and discharge of the decoating refuse and used blasting media have been found most troublesome.

While in the illustrated embodiment of FIGS. 1 and 2, the throwing wheels are shown as mounted at the side wall of the chamber, the invention is not limited thereto and is equally applicable to systems in which one or more throwing wheels are mounted at the top of the treating chamber, as well as systems employing a single throwing wheel at one or more side walls of the chamber or any combination thereof.

As shown in FIGS. 1 and 2, access to the chamber is had through hinged door 28, extending the full length of the chamber.

In the operation of the system illustrated in FIGS. 1 and 2, the articles to be treated may be suspended from means (not shown), in a stationary position or they may be rotated by such suspending means, during bombardment by the media. The fragments removed from the articles by the impact of the media, together with the used media, fall to the floor of the treating chamber.

The structure and operation of the means for collecting and discharging the material lying on the floor of the chamber with which the present invention is particularly concerned, will now be described. In the embodiment illustrated, sweeping device 30, having four arms 32, is mounted for rotation a short distance above the floor 33 of the chamber. During such rotation refuse and media lying on the floor 33 is swept counterclockwise (as shown by the arrow in FIG. 1) toward and into an opening 34 in floor 33. The material thus swept falls through chute 35 and is discharged into housing 36, from which it is picked up by screw conveyor within housing 36 and thereby transported to a separating station. At the separating station the media is separated from refuse, the latter being discarded while the clean media is recovered and recycled to the throwing wheels via the screw conveyor in housing 19.

In the illustrated embodiment of FIGS. 1 and 2, chamber 10 is shown as square in horizontal cross-section. At the four corners of the square, inclined baffles 38 are positioned at an angle of 45° with each of the intersecting walls forming a corner to direct media and refuse toward the sweep. The outer extremities of arms 32 are spaced a short distance from the walls of the chamber, and baffles 38 are spaced inwardly to provide approximately the same short distance for clearance by the outer extremities of arms 32 during their rotation.

Figure 3:
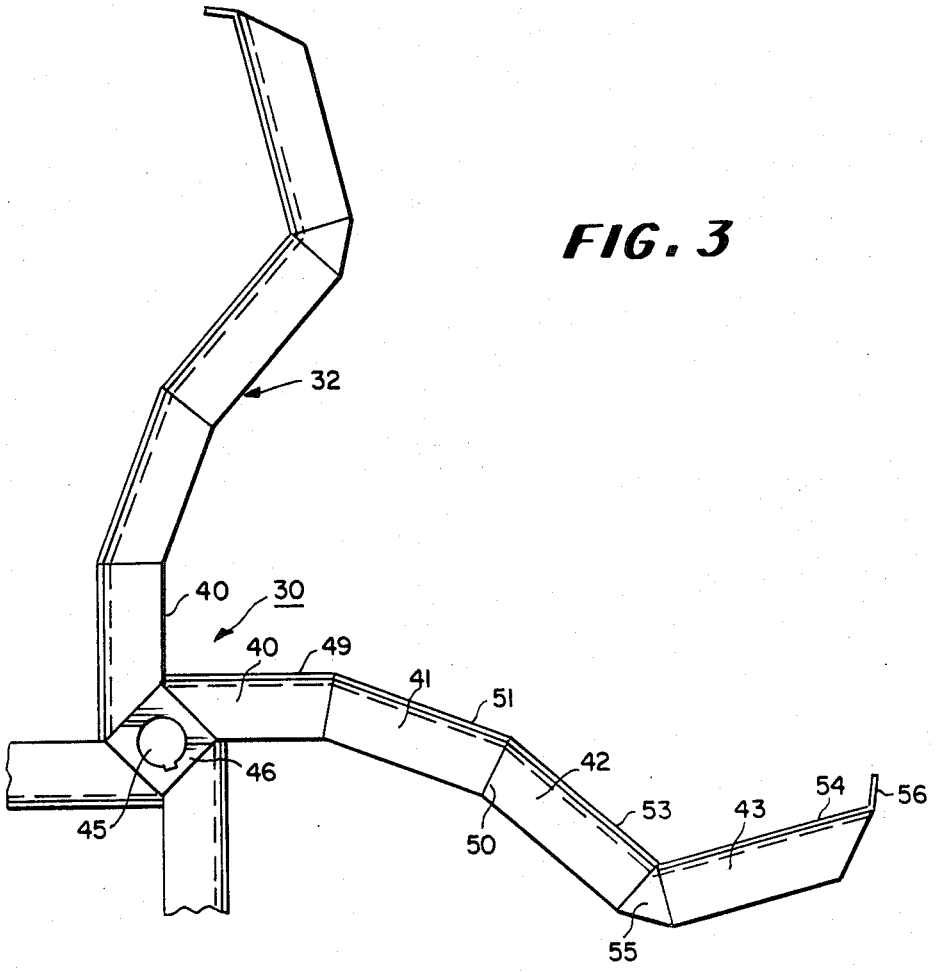
FIG. 3 is an enlarged partial plan view showing the construction of the arms of the sweeping device.

Details of the configuration of the arms 32 are illustrated in FIG. 3. As earlier indicated, the arms 32 are of a shape approximating an ogee curve. In the illustrated embodiment each arm 32 is made up of a series of connected straight segments. There are four such straight segments: 40, 41, 42, 43 shown. The sweeping device 30 is actuated by a drive shaft 45, extending from outside the chamber through the insulated floor and keyed at its upper extremity (see FIG. 3) within the chamber to a square hub 46. Each of the segments 40 is attached horizontally at a slant to a face of hub 46 and extends radially outward therefrom to form a right angle with a companion segment 40 circumferentially next adjacent. Each segment 40 takes the form of a trapezoid with one non-parallel short end attached to hub 46 and the opposite short end attached to the next adjacent segment 41. At the juncture of segment 40 and 41 the seam line slopes inwardly at an acute angle to the longer parallel side 49 of the trapezoid 40, so that segment 41 is directed away from the direction of travel forming an acute angle of about 15° to 30°, preferably 20° as shown in FIG. 3, with an extended line parallel to the forward long side 49 of section 40.

Each of segments 41 of the arms 32 is also in the shape of a trapezoid, the outer non-parallel short end 50 of which is sloped at an acute angle to the longer of the parallel sides 51 of the trapezoid. Thus, at the juncture where segment 42 is attached to segment 41, segment 42 is further directed away from the direction of travel at an angle of about 15° to 30°, as measured along a continuous line extending from the longest side 51 of segment 41 to the longest side 53 of the parallel sides of segment 42.

Segment 43 is attached to segment 42 by means of an intervening triangular or gore-like filler 55, with the apex of the filler at the juncture of side 53 of segment 42 and side 54 of segment 43. The angle formed at the intersection of sides 53 and 54 of segments 42 and 43 respectively, is an obtuse angle of about 130°. Thus, segment 43 is oriented in the direction of travel of sweep device 30. Referring again to FIG. 1, the juncture of segments 42 and 43 of arms 32 is at the circumference of an imaginary circle 60 having a radius such that the area of circle 60 is equal to the area of the annulus formed between circle 60 and circle 61 defining the path traversed by the outer edges of the arms of sweeping device 30 during rotation of the device.

The number of bends provided by the several segments of the sweep 30 and the magnitude of each band is fixed so as to provide a minimum angle between the vertical face of the arm and a radial line from the center of rotation. This angle is formulated to provide a positive motion of the mixture of material on the floor of the chamber, toward the opening 34 in the bottom of the chamber. Forward lip 56 is attached the segment 43 as shown to increase the capacity of sweep by enabling more material to be pushed ahead of each arm.

Figure 4:
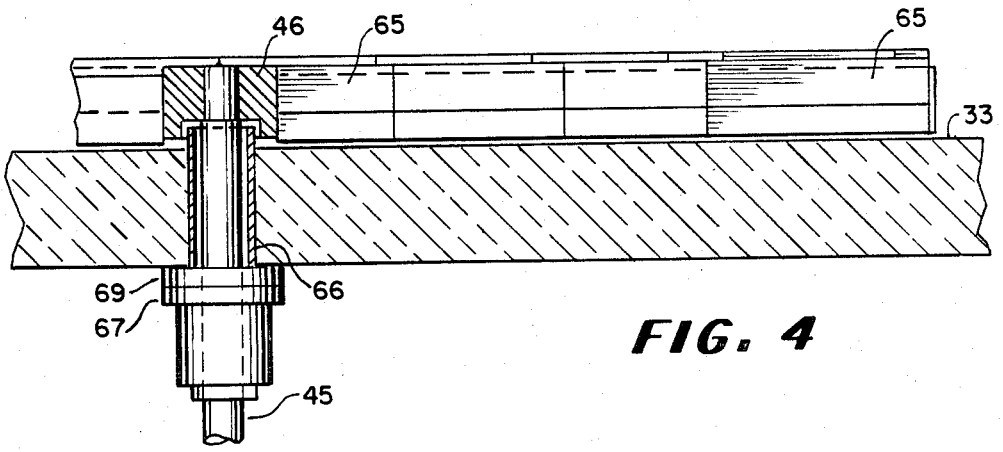
FIG. 4 is an enlarged partial elevation, partly in section, illustrating the drive shaft arrangement for the sweeping device detail shown in FIG. 3.

As seen in FIG. 4, there is attached to the vertical face of each arm a number of downwardly extending plates 65, that can be vertically adjusted to establish the spacing between the lower edges of the plates and the floor of the chamber. This spacing is determined by the size of the shot or pellets employed as blasting media. The size and shape of the refuse coating on flash is also a factor that should be considered when determining this spacing.

The drive arrangement for the media collection system is designed to minimize potential for jamming. Shaft 45 is driven from below by any suitable means (not shown) mounted at the exterior of the chamber. The shaft passes through the insulated bottom of the chamber surrounded by a sleeve or tube 66 which extends above the surface of floor 33. Tube 66 thus prevents water from flowing into the annular space around drive shaft 45 and entering the flanged bearing unit 67 in which the shaft is journaled at the bottom of the chamber.

The under face of hub 46 is counterbored to accommodate the upper end of the tube 66 and thus serves as a labyrinth seal preventing access of water and solid materials, such as uncured or tacky paint, mold release agents, flash or coating refuse, media particles, dust, dirt and the like, into the open end of the tube. A base plate 69 may be mounted between the exterior of the chamber and bearing unit 67 with passages in the plate for periodically admitting high pressure purge gas to blow any accumulation out of the annular space between shaft 45 and sleeve 66. This accumulation may be any one or more of the solid materials listed above, ice or liquid from the condensation of water vapor or other condensable gases and the condensable gases themselves. A small flow of the high pressure purge gas can be continually introduced into the annular space around shaft 45 to prevent any accumulation of such materials.

It was empirically determined by laboratory testing with pelleted polycarbonate resin as the blasting medium that the angle between the vertical face of sweep arm 32 and a radial line from the center of rotation should be at least 20°, to be assured that the material at the bottom of the chamber will be moved in the desired direction. The number of arms employed on sweep device 30 and the speed of rotation was established from the relationship:

Metric Units — English Units $$N = \frac{6.28m}{\rho dAn} \quad \text{or} \quad N = \frac{12m}{\rho dAn}$$

where

| | | Metric | English |
|---|---|---|---|
| N = | sweeper speed | radians/sec. | rpm |
| m = | media flow rate | kg./sec. | lbs./min. |
| n = | number of arms | | |
| $\rho$ = | bulk density of media | kg./m.$^3$ | lbs./ft.$^3$ |
| A = | area of chamber bottom | m.$^2$ | ft.$^2$ |
| d = | depth of media on bottom | m. | in. |

As a specific example employing a 1.219 m. (4 ft.) square blasting chamber and using polycarbonate as the medium, having a bulk density of 662 kg./m.$^3$ (41.3 lbs./ft.$^3$) at a flow rate of 0.454 kg./sec. (60 lbs./min.) and at a depth of $5.72\times10^{-3}$ m. (0.225 in.), the desired speed of rotation is calulated to be $$N = \frac{6.28\ (0.454)}{662(5.72\times10^{-3})\ (1.486)\ (4)} = 0.127\ \frac{\text{RADIAN}}{\text{SEC}}$$

or $$N = \frac{12\ (60)}{41.3\ (0.225)\ (16)\ (4)} = 1.21\ \text{rpm}$$

The number of arms and the rotational speed can be changed to suit the specific media employed and the depth of material at the bottom of the chamber.

While in the illustrated embodiment a square chamber is shown, it will be understood that the invention is not limited thereto. For a rectangular chamber bottom, several vaned media sweepers would be utilized, arranged as intersecting circles. The vertical shafts supporting the media sweepers would be mechanically driven to prevent the individual arms from interfering. Thus, for a system employing two sweepers, the mechanical drive would be arranged to move the sweepers in opposite rotation; that is, one would be rotated clockwise while the other is rotated counter-clockwise.

As indicated above, the preferred location for the forward bend of the sweep arm 32 is at the point at which the area of the circular path at which the material is moving outwardly is equal to that of the annular path in which the material is moved inwardly. Thus, for example, for a sweep arm having a full operating radius of 0.584 meters (23 inches), the location of the bend is calculated from the formula $r_m = r_s/\sqrt{2}$, where $r_s$ is the full operating radius of the arm and $r_m$ is the radius from the center to the forwardly bent segment.

$$r_m = 0.584/\sqrt{2} = 0.413\ \text{meters, or}$$

$$r_m = 23(0.707) = 16.26\ \text{in.}$$

It was also found that the plates 65 should be spaced at a distance of about 3 to 4 times the largest dimension of the blasting media used. Using, for example, cylindrical polycarbonate particles with nominal dimensions of 0.254 cm. (0.10 in.) diameter and 0.10 inch long, the plates 65 are preferably spaced 0.762 to 1.0 cm. (0.30 to 0.40 in.) from the floor of the chamber.

The media collection method and arrangement according to the present invention will provide reliable operation at a relative low equipment manufacturing cost. Thermal contraction of the sweep arms will have a negligible effect on its operation. Since the sweep device is mounted in a single flanged bearing unit outside the chamber and requires only a single shaft passing through the insulated chamber wall, heat leak into the chamber is minimized. Also, since the arrangement of the present invention requires only a height of about 7.6 cm. (3 inches) above the floor of the chamber (as compared to about 3.94 cm. (10 inches) using a drag conveyor and cross screw conveyor, the chamber can be made smaller, thus reducing coolant requirements and minimizing the steady state heat loss into the system.

What is claimed:

1. In apparatus for pellet blasting of articles to remove molding flash or coatings therefrom by projecting a high velocity stream of such pellets against the articles within a thermally insulated enclosure containing gaseous coolant; wherein the resulting mixture of pellets and refuse comprising fragments of removal flash or coating material is collected at the bottom of said enclosure and is screened to recover separated reusable pellets for recycling to the blasting apparatus, the improvement which comprises:

a rotating sweep device within said enclosure above the bottom thereof, said sweep device having a plurality of outwardly extending sweep arms traversing the bottom of said enclosure;

each of said sweep arms being attached to a central hub and shaped to approximate an ogee curve, with the innermost portion of each arm being displaced rearwardly away from the direction of rotation and the outermost portion being displaced forwardly in the direction of rotation, whereby respective portions of the mixture at the bottom of said enclosure are caused to move through adjoining paths, the innermost path being defined by a central circular area and the outermost path being defined by an annulus surrounding said circular area, such that the mixture within said circular area during rotation of said sweep device is caused to move radially outward and the mixture within said annulus is caused to move radially inward; and an opening in the bottom of said enclosure into which the mixture of pellets and refuse swept by said sweep device is discharged for transport to separation means for said mixture;

wherein said sweep device is driven by a shaft attached to said central hub, which shaft extends through said bottom of said enclosure and is surrounded by a tubular sleeve extending through said bottom to a level within said enclosure above said bottom and forming an annular space, and means for introducing a purge gas to expel solids, liquids and condensable gases from said annular space.

2. The improvement as defined in claim 1 wherein said means continuously introduces a purge gas into said annular space to prevent said solids, liquids and gases from entering said space.

3. A rotating sweeeping device capable of being mounted above the bottom of an enclosure and adjacent to an opening in said bottom, which comprises a plurality of outwardly extending sweep arms traversing the bottom of said enclosure for sweeping into said opening any solid materials that are introduced into said enclosure and that fall to said bottom; each of said sweep arms being attached to a central hub and shaped to approximate on ogee curve, with the innermost portion of each said arms being displaced rearwardly away from the direction of rotation and the outermost portion being displaced forwardly in the direction of rotation, wherein each of said sweep arms is so designed that said material moved thereby during its rotation is moved radially outward in the circular path traversed by the inner portion of each of said arms extending from the central hub and is moved radially inward in the adjoining annular peripheral path traversed by the outer portion of each of said arms, the area of said traversed circular path and the area of said annular path being substantially equal; wherein each of said sweep arms is made up of a connected series of straight segment portions to approximate said ogee curve.

4. The device as defined in claim 3 wherein said sweep device is driven by a shaft attached to said central hub, which shaft extends through said bottom of said enclosure and is surrounded by a tubular sleeve extending through said bottom to a level within said enclosure above said bottom, said shaft being journaled in a bearing member mounted at and against the exterior of the bottom wall of said enclosure; said central hub being counterbored at its under face to accommodate the upper open end of said sleeve, thereby providing a labyrinth seal preventing access of water and other materials through the open top end of said sleeve into said bearing member; and means for rotating said shaft connected thereto externally of said enclosure.

* * * * *